United States Patent [19]

Mizek

[11] Patent Number: 5,016,602

[45] Date of Patent: May 21, 1991

[54] NOISE AND RECOIL REDUCING BOW STABILIZER FOR ARCHERY BOWS

[76] Inventor: Robert S. Mizek, 1119 Westchester Blvd., Westchester, Ill. 60154

[21] Appl. No.: 467,664

[22] Filed: Jan. 19, 1990

[51] Int. Cl.[5] ..... F41B 5/00

[52] U.S. Cl. ..... 124/89; 188/378

[58] Field of Search ..... 124/23 R, 24 R, 86, 124/88, 89; 188/268, 378; 267/136

[56] References Cited

U.S. PATENT DOCUMENTS

| | | | |
|---|---|---|---|
| 3,342,172 | 9/1967 | Sanders | 124/89 X |
| 4,011,929 | 3/1977 | Jeram et al. | 188/268 |
| 4,324,222 | 4/1982 | Gasser | 124/89 |
| 4,478,204 | 10/1984 | Kocsan | 124/89 |
| 4,570,608 | 2/1986 | Masterfield | 124/89 |
| 4,615,327 | 10/1986 | Saunders | 124/89 |
| 4,660,538 | 4/1987 | Burgard | 124/89 |
| 4,779,602 | 10/1988 | Hess, Sr. | 124/89 |
| 4,893,606 | 1/1990 | Sisko | 124/89 |

FOREIGN PATENT DOCUMENTS

| | | | |
|---|---|---|---|
| 1296201 | 11/1972 | United Kingdom | 124/89 |

*Primary Examiner*—Peter M. Cuomo
*Assistant Examiner*—John A. Ricci
*Attorney, Agent, or Firm*—Thomas W. Speckman; Douglas H. Pauley

[57] ABSTRACT

A bow stabilizer is mounted to an archery bow for the purpose of balancing the archery bow and reducing recoil, shock and vibration forces and noise that results when an arrow is discharged from the archery bow. The bow stabilizer has a hollow body which defines a chamber. An end plug is sealably secured to an end of the hollow body and another end plug is sealably secured to an opposite end of the hollow body. The bow stabilizer has at least one counterweight which is adjustable along a longitudinal axis of the hollow body to balance the archery bow. The chamber of the hollow body is partially filled with granular solids.

19 Claims, 3 Drawing Sheets

NOISE AND RECOIL REDUCING BOW STABILIZER FOR ARCHERY BOWS

BACKGROUND OF THE INVENTION

1. Field of the Invention

The present invention relates to a bow stabilizer that is mounted to an archery bow. The bow stabilizer is attached to the archery bow for the purpose of balancing the archery bow and reducing recoil, shock, vibration and noise that results when an arrow is discharged from the archery bow 2. Description of the Prior Art In recent years, various stabilizers and vibration dampeners have been developed to both balance and absorb the shock when an arrow is discharged from an archery bow. U.S. Pat. No. 4,570,608 teaches an archery bow stabilizer and vibration dampener that are mounted on an archery bow. As taught by the '608 patent, a hollow cylinder is filled with a viscous fluid, such as oil, to attenuate vibration when an arrow is discharged from the archery bow. An energy dissipating rod, located inside the hollow cylinder, is connected to a stud which screws into a riser of the archery bow. The energy dissipating rod is in direct contact with the viscous fluid. The stabilizer rod transfers energy to the viscous fluid when an arrow is discharged from the archery bow. One end of the hollow cylinder is permanently sealed to prevent the escape of the viscous fluid. The other end of the cylinder has a plug and rubber sealing ring which prevents the viscous fluid from escaping from the cylinder. A variety of external weights having different masses are threaded onto an end of the stabilizer to provide additional balancing for the archery bow. As taught by the '608 patent, the stabilizer is approximately 18 inches in length. However, field experimentation is necessary to adequately balance the archery bow. In order to balance the bow using this stabilizer, differently sized weights are attached to the end of the stabilizer until the archery bow is balanced. Thus, the hunter is required to have at his disposal a variety of additional weights to fine tune and properly adjust or balance the archery bow. One disadvantage is that the length required to absorb the energy and vibrations is too long to effectively permit hunting of game animals. Additionally, placing weights at the end of the stabilizer to balance the bow makes the stabilizer even longer and has an unattractive appearance.

U.S. Pat. No. 4,779,602 teaches a rod or central cylindrical core that is threaded onto the forward side of an archery bow. The '602 patent teaches a sleeve that is slidable on the core and biased on the rear of the core by a stiff spring. When the bow string is released and an arrow is discharged, the sleeve slides forward by momentum to absorb the shock produced The sleeve, upon firing, moves forward and is then snapped back by a spring force which acts as a resilient shock absorber. The '602 patent further teaches that a receptacle, located at the end of the core, is loaded with lead pellets or shot to balance the bow in the hand of the archer. Similar to the '608 patent the '602 patent has a disadvantage because it requires the hunter to carry additional weights, lead pellets or shot, to properly adjust the archery bow. Another disadvantage is that the length of the stabilizer is increased by locating the additional balancing weight at the end of the stabilizer.

U.S. Pat. No. 4,615,327 teaches a two stage resiliently mounted stabilizer having a first and a second housing that are attached to an archery bow. The first housing is resiliently mounted to the archery bow. The second housing is resiliently mounted to an end of the first housing. The first housing has a first rubber tube which is inside the first housing. A flat resilient washer separates the two housings and a connecting member is used to connect and tighten the second and third rubber members. This allows the second housing to move with respect to the first housing. Additional weights may be connected to the end of the second housing. One disadvantage is that the characteristics and properties of rubber do not adequately solve the archer's needs in dampening vibrations and reducing noise when an arrow is discharged from the archery bow. Another disadvantage is that the stabilizer is generally too long to be used for hunting game animals. Another disadvantage is that weight added at the end of the stabilizer increases the length and adds too much weight to the archery bow, causing fatigue to the archer. Yet another disadvantage is that the stabilizer performance will change with a change in temperature as the fluid viscosity changes. Under hunting conditions, such change in stabilizer performance results in a decrease of bow accuracy.

U.S. Pat. No. 4,660,538 teaches another stabilizer mounted to an archery bow. A spring is compressed by rotating a nut located at the end of the stabilizer. A weight may be added to the opposite end. The spring design of the '538 patent has a disadvantage because it provides insufficient stabilization. The length of the stabilizer is generally too long and hence impractical for use in hunting.

SUMMARY OF THE INVENTION

It is an object of this invention to provide a bow stabilizer that is short in length, lightweight and has a counterweight which does not add to the length of the bow stabilizer.

It is another object of this invention to provide a bow stabilizer for archery bows that balances the archery bow and reduces the recoil, shock, vibration and noise that result when an arrow is discharged from the archery bow.

It is another object of this invention to provide a bow stabilizer having a hollow body which defines a sealed chamber that is partially filled with granular solids. The bow stabilizer has mounting means for mounting itself to the archery bow. The chamber of the bow stabilizer is partially filled with granular solids.

It is another object of this invention to provide a bow stabilizer having an elongated hollow body which defines a sealed chamber that is partially filled with granular solids. The bow stabilizer has at least one end plug for sealing and containing the granular solids within the chamber. The bow stabilizer has mounting means for mounting itself to the archery bow and a counterweight that is fixedly adjustable along a longitudinal axis of the elongated hollow body.

It is a further object of this invention to provide a bow stabilizer that has a chamber partially filled with sand, crushed stone, plastic particles, metal particles, or any other suitable granular solids to absorb the energy of the archery bow when an arrow is discharged.

It is yet another object of this invention to fill approximately 50 to 99 percent of the sealed chamber with the granular solids.

The above objects are achieved in the present invention with a bow stabilizer that is mounted to an archery bow. The bow stabilizer has a hollow body which defines a sealed chamber. In a preferred embodiment, the hollow body has an elongated shape. An end plug is sealably secured to an end of the elongated hollow body and an end plug is sealably secured to an opposite end of the hollow body. The bow stabilizer has mounting means for mounting itself to an archery bow. A counterweight is fixedly adjustable along a longitudinal axis of the elongated hollow body. The sealed chamber of the hollow body is partially filled with granular solids.

The granular solids which partially fills the chamber may be sand, crushed stone, plastic particles, ceramic particles, metal particles and/or any other suitable granular solids. In a preferred embodiment, the granular solids has a generally average particle size. The size of the particles should be less than approximately ⅛ inch. Preferably, the size of the particles should be approximately 15–20 mils. These particles effectively absorb the shock and thus reduce recoil, vibration and noise that results when the arrow is discharged from the archery bow. By reducing the noise when an arrow is discharged from the archery bow, scaring game animals is virtually eliminated and thus allows the hunter to take a second shot, should the first shot miss the intended target. Thus, a hunter may be able to shoot multiple arrows at the targeted game animal. The benefits of this invention are equally great in marksmanship contests since recoil or "kick" is reduced, allowing the marksman to shoot with greater accuracy.

It is an important aspect that the chamber is only partially filled with granular solids. The chamber is approximately 50 to 99 percent filled with the granular solids. In a preferred embodiment, the chamber is approximately 70 to 95 percent filled. By only partially filling the chamber of the hollow body, the movement of the granular solids particles is less restrictive and such movement allows the granular solids to effectively absorb the energy of the archery bow when an arrow is discharged.

In a preferred embodiment, the mounting means comprise an end plug having a threaded shaft. Archery bows conforming to Archery Manufacturers Organization (AMO) standards have an internally threaded coupling positioned on a riser section. The threaded shaft of the end plug is secured within such internally threaded coupling. It is not critical how the bow stabilizer is mounted to the archery bow, so long as it is secured to the archery bow. In another embodiment, the mounting means comprise the end plug having a shaft which is press fitted into the internally threaded female coupling of the archery bow. In addition to the various methods of securing the bow stabilizer to the archery bow, sealing means for sealing the chamber may be interposed between the hollow body and the end plugs. Preferably, the sealing means comprise an O-ring or any other suitable design. The sealing means may be a rubber washer. A lock nut may also be threaded on the threaded shaft to lock the bow stabilizer with respect to the archery bow.

In another preferred embodiment, the end plugs are sealably secured to ends of the hollow body. In this particular embodiment, the end plugs each have a cap portion. The cap portion of each end plug has a chamfered edge. A connecting portion of each end plug has a knurled surface. In one embodiment, the end plugs are secured to the hollow body by an interference fit or press fit. The end plugs can also be welded to the hollow body or secured to the hollow body by a threaded connection. If the end plugs are secured to the hollow body by a threaded connection, the connecting portion of each end plug will have a threaded shaft and the hollow body will have an internal female coupling mateable with each end plug.

At least one counterweight is fixedly adjustable along a longitudinal axis of the hollow body. In a preferred embodiment, the counterweight is formed as a generally cylindrical collar. Positioning the counterweight along the longitudinal axis of the hollow body does not increase the length of the stabilizer. In addition to providing an aesthetic design, the overall compact design of the present invention allows an archer to carry the bow through dense woods and forests without catching the bow stabilizer on branches, shrubs, trees, and the like. Additionally, a bow stabilizer according to this invention is unaffected by the elements of nature. For example, the performance of the bow stabilizer is unaffected by extreme moisture and temperature conditions. The prior art teaches metal springs which will rust and rubber connections which will deteriorate over time. Additionally, the prior art teaching viscous fluids for dampening shock from the bow will have much different characteristics as the temperature changes and the viscosity of the liquid fluid changes. The present invention solves this problem and others.

In another preferred embodiment of this invention, the counterweight is threaded onto the hollow body. In this embodiment, the hollow body has an externally threaded surface. The cylindrical counterweight has an internally threaded female coupling that mates with the externally threaded surface of the hollow body. By rotating the counterweight with respect to the hollow body, the counterweight moves along a longitudinal axis and the archery bow is balanced. More than one counterweight may be mounted along the longitudinal axis of the hollow body. The counterweight can also comprise a split ring. In another preferred embodiment, the counterweight has a set screw for preventing longitudinal movement of the counterweight with respect to the hollow body. The set screw can be used whether or not the hollow body has an externally threaded surface.

DESCRIPTION OF PREFERRED EMBODIMENTS

Over the past decades, archery bow hunting and archery marksmanship have become quite popular. Although today's modern archery bows are a vast improvement over earlier bows, there is still a great demand for an effective, reliable, economical archery bow stabilizer. Although some bow stabilizers have been introduced, none of them solve the needs of today's hunter and marksman.

Figure 1:
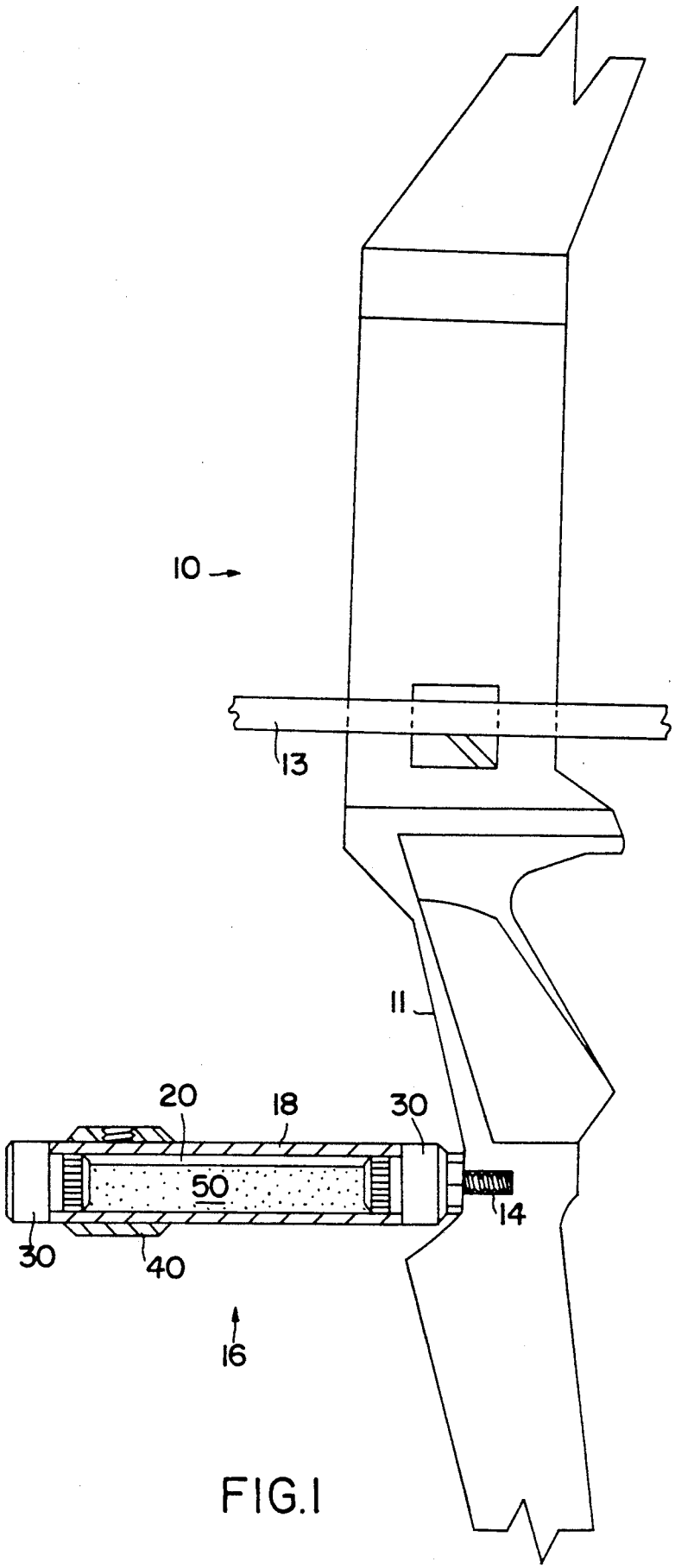
FIG. 1 shows a preferred embodiment of a bow stabilizer mounted to an archery bow.

As shown in FIG. 1, this invention solves this need by providing bow stabilizer 16 that is mounted to archery bow 10. Bow stabilizer 16 has a hollow body 18 which defines sealed chamber 20. Chamber 20 is partially filled with granular solids 50. In one embodiment of this invention, granular solids 50 fills approximately 50 to approximately 99 percent of chamber 20, preferably approximately 70 to approximately 95 percent.

Figure 2:
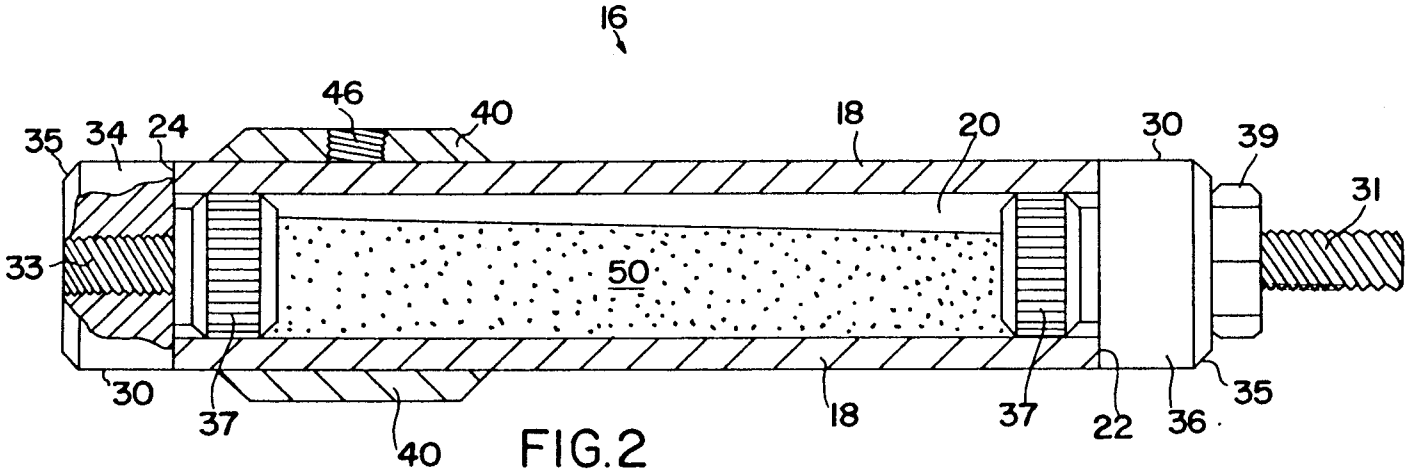
FIG. 2 shows a partial cross-sectional view of a bow stabilizer according to a preferred embodiment.

As shown in FIG. 1, according to a preferred embodiment of this invention, archery bow 10 has internally threaded female coupling 14 for securing and mating bow stabilizer 16. Internally threaded female coupling 14 conforms to Archery Manufacturers Organization (AMO) standards. According to the AMO standards, the thread size of the female coupling is 5/16"×24. As shown in FIG. 2, elongated hollow body 18 has end 22 and end 24. End plug 30 is sealably secured to end 22 and end plug 30 is sealably secured to end 24. At least one counterweight 40 is fixedly adjustable along a longitudinal axis of elongated hollow body 18.

According to one preferred embodiment, granular solids 50 is sterilized sand that is free of foreign matter. The sand should be thoroughly dried before it is used to partially fill chamber 20. Preferably, the sand or other granular solids 50 comprise particles of generally average size. The term "average size" used throughout the specification and claims means that the shapes and diameters of particle sizes may vary, but that the individual particle shapes and diameters should not be grossly disproportionate to one another. The average size of particles of granular solids 50 is approximately less than about ⅛ of an inch. Preferably, the particle size is in the range of approximately 15 to 20 mils. In addition to sand, granular solids 50 may also comprise crushed stone, plastic particles, ceramic particles, metal particles, or any other suitable material that transfers energy through friction when the particles of granular solids 50 move against the inner wall of hollow body 18 and each other. Additionally, this invention is not limited to use of one particular type of granular solids 50. For example, chamber 20 may be partially filled with sand, plastic particles, and crushed stones. Sealing means (not shown) may be interposed between end plugs 30 and hollow body 18. Sealing means may comprise a gasket or an O-ring or any other type of suitable material. A gasket, such as a rubber washer, will prevent very fine granular solids 50 from leaking from chamber 20.

In a preferred embodiment, hollow body 18 is constructed of any suitable, lightweight, rigid material. For example, hollow body 18 may be constructed of a metal alloy, plastic, fiberglass, or the like. Preferably, the material selected for hollow body 18 is one which does not corrode or deteriorate over time. Although the shape of hollow body 18 is preferably elongated, as shown in FIGS. 1 and 2, hollow body 18 can have other suitable shapes. For example, hollow body 18 may have an overall tapered shape or it may be necked down in a mid region. Although hollow body 18 is preferably cylindrical, the cross-sectional shape is not critical and hollow body 18 may have various other suitable polygonal cross-sectional shapes, such as a rectangular or a triangular shape. In another preferred embodiment, two or more bow stabilizers 16 can be secured side-by-side to increase the internal surface area of hollow body 18 and thus achieve increased energy absorption.

It is preferred but not necessary for hollow body 18 to have two end plugs 30. Hollow body 18 may be drilled so that only one end is open and hence either end plug 30 is required. Practically any method of sealably securing end plugs 30 to hollow body 18 will suffice. End plugs 30 can be either press fitted or welded to hollow body 18.

In another preferred embodiment, end plugs 30 each have a cap portion 34. Cap portion 34 has a chamfered edge 35 to prevent any sharp edges. End plugs 30 each have a connecting portion 36 connected to cap portion 34. Preferably, connecting portion 36 has a peripheral knurled surface 37. Knurled surface 37 provides sufficient friction and interference fit to secure end plugs 30 to hollow body 18. With an interference fit, the diameter of connecting portion 36 is less than the diameter of cap portion 34. In addition to knurled surface 37, any other type of treated or machined surface will suffice to sealably secure end plugs 30 to hollow body 18.

In another preferred embodiment, each end plug 30 is secured to hollow body 18 with a threaded connection. In this embodiment, each end plug 30 has an externally threaded shaft, not shown in FIGS. 1-3. Hollow body 18 has internally threaded female coupling 33, also not shown in FIGS. 1-3, located at ends 22 and 24 of hollow body 18. In this embodiment, the externally threaded shaft of each end plug 30 is mateable with the internally threaded female coupling of each end 22 and 24.

It is also apparent that each end plug 30 can have an internally threaded female coupling 33, as shown in FIG. 2. Threaded shaft 31 is secured and mated with internally threaded female coupling 33. It is apparent that threaded shaft 31 can be secured to either end plug 30. Additionally, a conventional game tracker may be attached to one of end plug 30.

In a preferred embodiment, threaded shaft 31 is mateable with internally threaded female coupling 14 located on front side 11 of archery bow 10. Although not necessary, as shown in FIG. 2, lock nut 39 may be threaded on threaded shaft 31 for additionally securing bow stabilizer 16 to archery bow 10. In one embodiment, mounting means for securing bow stabilizer 16 to archery bow 10 comprise a shaft secured to one of end plugs 30 having a shaft which is press fitted into internally threaded female coupling 14 of archery bow 10. In this embodiment, the shaft is made of a soft material which does not damage the internal threads of internally threaded female coupling 14.

In addition to suppressing noise and reducing recoil, shock and vibration, as shown in FIGS. 1 and 2, bow stabilizer 16 can have at least one counterweight 40 for balancing archery bow 10. Counterweight 40 is adjustable along a longitudinal axis 26 of hollow body 18. In one embodiment, counterweight 40 slides with respect to hollow body 18 along a longitudinal axis of elongated hollow body 18. Frictional forces prevent counterweight 40 from moving longitudinally once archery bow 10 is balanced. Counterweight 40 preferably has the form of a cylindrical collar. Counterweight 40 may also comprise a split ring configuration, which is not shown in the drawings. In a preferred embodiment, counterweight 40 has set screw threaded coupling 46 which accommodates a set screw for preventing longitudinal movement of counterweight 40 with respect to elongated hollow body 18, once archery bow 10 is balanced. The set screw, not shown in the drawings, has a wing nut or any other type of screw which does not require tools for field tightening or loosening.

In another embodiment according to this invention, counterweight 40 has an internally threaded female coupling. In this embodiment, hollow body 18 has an externally threaded surface which mates with the internally threaded female coupling. Archery bow 10 is balanced by conveniently rotating counterweight 40 with respect to hollow body 18. Hence, the need to carry additional weights is entirely eliminated.

As shown in FIG. 1, bow stabilizer 16 is firmly secured to archery bow 10, preferably at front side 11 of the bow handle riser. Upon release of a bowstring and discharge of arrow 13, recoil and vibration forces are transferred through the bow limbs and into the bow handle riser. This vibration causes noise and loosening of accessories mounted on archery bow 10. The vibrational energy is transferred to granular solids 50 which absorbs the energy as the particles of granular solids 50 collide with one another and the inner wall surface of hollow body 18.

Figure 3:
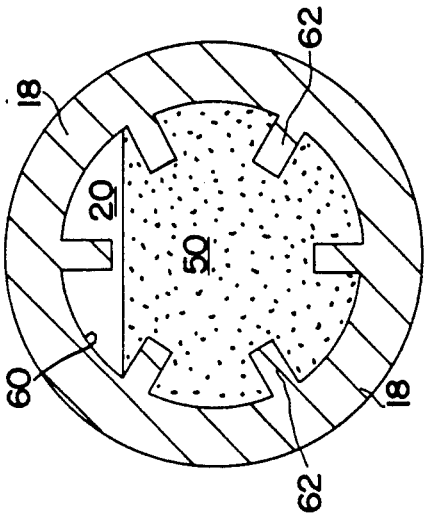
FIG. 3 shows a cross-sectional view through a hollow body of a bow stabilizer having internal baffles, according to one embodiment of this invention.
Figure 4:
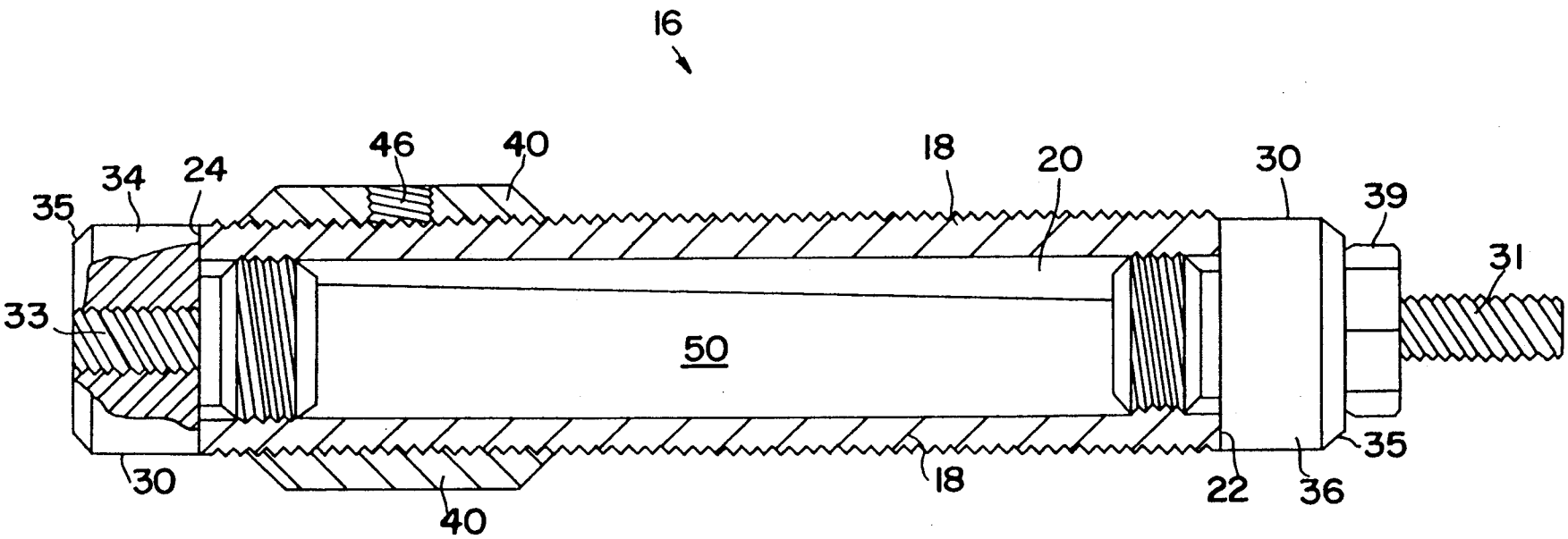
FIG. 4 shows a partial cross-sectional view of a bow stabilizer according to another preferred embodiment of this invention.

To further reduce and dissipate the recoil, shock and vibration forces and noise that results when arrow 13 is discharged from archery bow 10, hollow body 18 can have internal baffle means for increased surface area against which the particles of granular solids 50 collide. According to a preferred embodiment as shown in FIG. 3, hollow body 18 has an inner body wall 60 with projecting ribs 62. In this embodiment, ribs 62 extend along the length of chamber 20, preferably parallel to the longitudinal axis of hollow body 18. The design configuration of ribs 62 is not critical so long as the configuration provides a suitable shape for causing the individual particles of granular solids 50 to further collide with one another and inner body wall 60.

Accordingly, it is appreciated that the disclosed preferred embodiments accomplish the objects of this invention. Obviously, many modifications and variations of this invention are possible, in light of the above teachings. It is therefore understood that, within the scope of the appended claims, the invention may be practiced otherwise as specifically described and can be varied considerably without departing from the basic principles of the invention.

I claim:

1. A bow stabilizer for an archery bow, said bow stabilizer comprising:

an elongated hollow body, said elongated hollow body defining a sealed chamber;

a first end plug and a second end plug, said first end plug and said second end plug each having a cap portion, said first end plug and said second end plug each having a connecting portion, said connecting portion having a knurled surface, a connecting portion diameter being less than a cap portion diameter;

said first end plug and said second end plug sealably secured to said elongated hollow body;

a threaded shaft secured to said first end plug, said archery bow having an internally threaded female coupling, said threaded shaft mateable with said internally threaded female coupling;

a counterweight, said counterweight fixedly adjustable along a longitudinal axis of said elongated hollow body; and granular solids, said sealed chamber partially filled with said granular solids.

2. A bow stabilizer according to claim 1 wherein said granular solids comprises sand.

3. A bow stabilizer for an archery bow, said bow stabilizer comprising:

a hollow body, said hollow body defining a sealed chamber;

mounting means for securing said bow stabilizer to said archery bow;

a first end plug and a second end plug, said first end plug and said second end plug sealably secured to said hollow body, and at least one of said first end plug and said second end plug having an internally threaded female coupling, said first end plug and said second end plug each having a cap portion, a connecting portion secured to said cap portion, and a connecting portion diameter being less than a cap portion diameter; and granular solids, said sealed chamber partially filled with said granular solids, and sealing means for sealing said granular solids within said sealed chamber.

4. A bow stabilizer according to claim 3 wherein said granular solids fill approximately 50 to approximately 99 percent of said sealed chamber.

5. A bow stabilizer according to claim 3 further comprising at least one counterweight and each said counterweight fixedly adjustable along a longitudinal axis of said hollow body.

6. A bow stabilizer according to claim 5 wherein each said counterweight forms a generally cylindrical collar.

7. A bow stabilizer according to claim 6 wherein each said collar has internal threads, said hollow body has an externally threaded surface, said internal threads are mateable with said externally threaded surface, and upon rotating said counterweight with respect to said bow stabilizer said counterweight moves along said longitudinal axis of said bow stabilizer.

8. A bow stabilizer according to claim 5 wherein each said counterweight comprises a set screw and defines an internally threaded female coupling mateable with said set screw for preventing longitudinal movement of each said counterweight with respect to said hollow body.

9. A bow stabilizer according to claim 3 wherein said hollow body is elongated.

10. A bow stabilizer according to claim 3 wherein said granular solids comprises at least one of sand, crushed stone, plastic particles, and metal particles.

11. A bow stabilizer according to claim 10 wherein said granular solids has generally average particle sizes.

12. A bow stabilizer according to claim 11 wherein said generally average particle sizes have a diameter of less than about 150 of an inch.

13. A bow stabilizer according to claim 3 wherein said mounting means comprises an externally threaded shaft secured to said first end plug, said archery bow having an internally threaded female coupling, and said externally threaded shaft mateable with said internally threaded female coupling.

14. A bow stabilizer according to claim 3 wherein said sealing means further comprises a first end plug and a second end plug each forming an interference fit within said hollow body.

15. A bow stabilizer according to claim 3 wherein said first end plug and said second end plug are secured to said hollow body with a threaded connection.

16. A bow stabilizer for an archery bow, said bow stabilizer comprising:

a hollow body, said hollow body defining a sealed chamber;

mounting means for securing said bow stabilizer to said archery bow;

at least one counterweight, each said counterweight fixedly adjustable along a longitudinal axis of said hollow body, each said counterweight forming a generally cylindrical collar;

each said counterweight having an internally threaded female coupling, said hollow body having an externally threaded surface, said internally threaded female coupling mateable with said externally threaded surface, and upon rotating said counterweight with respect to said bow stabilizer said counterweight moves along said longitudinal axis of said bow stabilizer; and granular solids, said sealed chamber partially filled with said granular solids.

17. A bow stabilizer according to claim 16 wherein each said counterweight comprises a set screw and an internally threaded female coupling mateable with said set screw for preventing longitudinal movement of each said counterweight with respect to said hollow body.

18. A bow stabilizer for an archery bow, said bow stabilizer comprising:

a hollow body, said hollow body defining a sealed chamber;

mounting means for securing said bow stabilizer to said archery bow;

granular solids, said sealed chamber partially filled with said granular solids; and baffle means for further restricting movement of said granular solids, and said baffle means positioned within said sealed chamber.

19. A bow stabilizer according to claim 18 wherein said baffle means further comprise an inner body wall of said hollow body, and at least one rib projecting from said inner body wall.

* * * * *

UNITED STATES PATENT AND TRADEMARK OFFICE

CERTIFICATE OF CORRECTION

PATENT NO. : 5,016,602

DATED : May 21, 1991

INVENTOR(S) : Robert S. Mizek

It is certified that error appears in the above—identified patent and that said Letters Patent is hereby corrected as shown below:

Column 8, Claim 12, line 48 delete "150" and in its place insert -- 1/8 --.

Signed and Sealed this

Twenty-fourth Day of May, 1994

Bruce Lehman

*Attest:*

BRUCE LEHMAN

*Attesting Officer*

*Commissioner of Patents and Trademarks*